US008307481B2

(12) United States Patent
Katan

(10) Patent No.: US 8,307,481 B2
(45) Date of Patent: Nov. 13, 2012

(54) BODY SUPPORT PLATFORM

(76) Inventor: Joseph Meir Katan, North Finchley (GB)

( * ) Notice: Subject to any disclaimer, the term of this patent is extended or adjusted under 35 U.S.C. 154(b) by 0 days.

(21) Appl. No.: 13/496,358

(22) PCT Filed: Oct. 10, 2011

(86) PCT No.: PCT/GB2011/051946

§ 371 (c)(1),
(2), (4) Date: Mar. 15, 2012

(87) PCT Pub. No.: WO2012/049481

PCT Pub. Date: Apr. 19, 2012

(65) Prior Publication Data

US 2012/0192358 A1 Aug. 2, 2012

(30) Foreign Application Priority Data

Oct. 12, 2010 (GB) ..... 1017183.3
Oct. 13, 2010 (GB) ..... 1017248.4

(51) Int. Cl.
*A47C 27/10* (2006.01)

(52) U.S. Cl. ..... 5/710; 5/713; 5/726; 5/709

(58) Field of Classification Search ..... 9/710, 713, 9/726

See application file for complete search history.

(56) References Cited

U.S. PATENT DOCUMENTS 2,434,641 A 1/1948 Burns
2,655,369 A * 10/1953 Musilli ..... 267/113
3,605,145 A 9/1971 Graebe
4,685,163 A 8/1987 Quillen et al.
4,750,224 A * 6/1988 Stracke ..... 5/655.3
4,852,195 A * 8/1989 Schulman ..... 5/713
4,864,671 A * 9/1989 Evans ..... 5/713
4,907,307 A * 3/1990 Weitzler ..... 5/665
5,030,501 A 7/1991 Colvin et al.
5,638,565 A * 6/1997 Pekar ..... 5/710
6,009,580 A * 1/2000 Caminade et al. ..... 5/713

(Continued)

FOREIGN PATENT DOCUMENTS

CN 201675488 U 12/2010

(Continued)

OTHER PUBLICATIONS

Jan. 31, 2012 International Search Report issued in International Application No. PCT/GB2011/051946.

(Continued)

*Primary Examiner* — Robert G Santos
*Assistant Examiner* — Brittany Wilson
(74) *Attorney, Agent, or Firm* — Oliff & Berridge, PLC

(57) ABSTRACT

A body support platform for supporting a human body, comprising one or more body support unit(s), the or each support unit comprising a plurality of columns, each column comprising a stack of fluid-fillable substantially spherical resilient balls, each ball of a respective column being physically and fluidly connected only to the adjacent ball(s) within said column, such that a column may be compressed substantially independently of a neighboring column; and a base providing a primary fluid reservoir; wherein said columns are arranged in an array across said base; and each of aid columns is connected to said base, such that the lowermost ball of each respective column is directly fluidly connected to said primary fluid reservoir; and wherein the uppermost ball of respective columns collectively define a body support surface.

20 Claims, 19 Drawing Sheets

U.S. PATENT DOCUMENTS

| | | | | |
|---|---|---|---|---|
| 6,286,167 | B1 * | 9/2001 | Stolpmann | 5/737 |
| 6,415,467 | B1 * | 7/2002 | Bretvin | 5/710 |
| 7,587,776 | B2 * | 9/2009 | Poulos | 5/713 |
| 2003/0192126 | A1 | 10/2003 | del Drago | |
| 2004/0107503 | A1 * | 6/2004 | Tu | 5/710 |
| 2004/0177449 | A1 * | 9/2004 | Wong et al. | 5/713 |
| 2006/0085919 | A1 * | 4/2006 | Kramer et al. | 5/713 |
| 2007/0256245 | A1 * | 11/2007 | Kammer et al. | 5/655.3 |
| 2008/0029940 | A1 * | 2/2008 | Kammer et al. | 267/117 |
| 2009/0265857 | A1 * | 10/2009 | Habegger | 5/713 |

FOREIGN PATENT DOCUMENTS

| | | | |
|---|---|---|---|
| DE | 297 03 414 | U1 | 6/1997 |
| EP | 0 736 278 | A1 | 10/1996 |
| EP | 1 500 353 | A1 | 1/2005 |
| WO | WO 91/06235 | | 5/1991 |
| WO | WO 2004/019733 | A1 | 3/2004 |
| WO | WO 2007/021878 | A2 | 2/2007 |

OTHER PUBLICATIONS

Jan. 31, 2012 Written Opinion issued in International Application No. PCT/GB2011/051946.

Feb. 11, 2011 Search Report issued in British Application No. GB1017248.4.

* cited by examiner

BODY SUPPORT PLATFORM

FIELD OF THE INVENTION

The present invention relates to a body support platform for providing support to the body of a person.

BACKGROUND OF THE INVENTION

There is a requirement to provide a comfortable body support platform for human beings. The most common body support platforms are furniture including beds, couches, sofas, seats, benches, chairs, sofas etc. Other body support platforms can include operating tables, physiotherapist's tables, dentist's chairs, sun-beds etc. Thus the term body support platform encompasses any construction having a support surface on which a human being lies or sits for a period of time.

The support surface that is required to provide body support for the longest period of time in any person's life is a bed. A great deal of work has been carried out in the field of conventional beds and mattresses in order to provide a comfortable sleeping position for people overnight. One of the problems is that people vary greatly in height and weight as well as their physical condition. For example some people are prone to back conditions.

Conventional mattresses are formed from a number of springs linked to form the mattress. Such springs are not able to move independently. More expensive mattresses attempt to overcome this by placing the springs in individual pockets. However, the pockets need to be contained and a significant layer of padding material is placed over the springs to enhance comfort. This layer prevents the springs from truly acting independently. To provide for different weight people, mattresses can be provided with different spring tensions e.g. soft, medium and firm. However, the spring tension is applied across the whole of the mattress and hence cannot compensate for different user's body shapes. Also, if, after time, certain springs of the mattress become damaged or worn, or if the body shape or weight of the person changes, it is not possible to replace the springs. The mattress is a sealed unit. It can only be turned to offer a different spring region to the user's body regions.

Once a mattress is worn, the only option is for it to be disposed of. Recycling of conventional mattresses is difficult because of the unitary nature of the mattress and the mixture of types of material used. This presents a significant environmental issue.

The unitary nature of conventional mattresses provides a barrier to providing bespoke mattresses for users. The construction of spring pockets with layers of wadding on top make it difficult to offer a bespoke bed design.

Further, since conventional mattresses are formed of springs and fabric material they are difficult and expensive to clean when they become soiled or infested with bed lice or other human disease agents.

It is one object of the present invention to provide an improved body support platform.

SUMMARY OF THE INVENTION

In one aspect the present invention provides a body support platform for supporting a human body, comprising one or more body support unit(s), the or each support unit comprising:

a plurality of columns, each column comprising a stack of fluid-fillable substantially spherical resilient balls, each ball of a respective column being physically and fluidly connected only to the adjacent ball(s) within said column, such that a column may be compressed substantially independently of a neighbouring column; and a base providing a primary fluid reservoir;

wherein said columns are arranged in an array across said base; and each of said columns is connected to said base, such that the lowermost ball of each respective column is directly fluidly connected to said primary fluid reservoir; and wherein the uppermost ball of respective columns collectively define a body support surface.

Preferably, at least one ball in a column has a different resiliency to at least one other ball in said column. Conveniently, the resiliency of at least one ball in a column is less than the resiliency of the/a lower ball(s) in said column. Advantageously, the resiliency of each ball in a column is less than the resiliency of the ball directly beneath it in said column. Preferably, at least one ball in a column is made of a different material to that of at least one other ball in said column. Advantageously, at least one ball in a column has a thicker wall than that of at least one other ball in said column. Conveniently, at least one ball in a column has a different surface texture to at least one other ball in said column. Preferably, the surface of at least one ball in a column is provided with at least one protrusion.

In one embodiment, at least one band is provided around the or each unit to affect the resiliency of said unit(s). Preferably the height of the band is less than the height of a ball. Preferably, the band is provided around the outermost columns of the unit, such that the band lies substantially horizontally and co-planer with the body support surface. Advantageously, the band contacts the equators of the respective balls of at least some of the outermost columns and lies substantially in a plane including the equator of each said ball. Conveniently, the band lies substantially in a plane including the physical connections between respective adjacent balls of each outermost column.

In one embodiment, a plurality of bands are provided around the unit, spaced apart from one another, wherein the resiliency of each band around said unit is different to that of at least one of the other band(s) around said unit. Preferably, at least one band around said unit is made from a different material to another band around said unit. Conveniently, at least one band around said unit has a greater thickness than another band around said unit.

In one embodiment, a sleeve is provided around at least a part of the unit to affect the resiliency of said unit. Preferably, the sleeve substantially surrounds the outermost columns. Conveniently, the sleeve is resilient.

In one embodiment, the adjacent balls within a column are physically connected to one another by means of fusion, glue, mechanical attachments or Velcro™, In one embodiment, the balls in a column are fluidly connected by means of openings, valves or a fluid conduit which traverses the height of said column.

In one embodiment, at least one column is removably connected to the base.

In one embodiment, a unit comprises an array of N×M columns arranged in a regular grid pattern.

In one embodiment, the balls are arranged in layers parallel to the body support surface. Preferably, the balls are made from a material that is elastic and substantially air impermeable. Conveniently, the balls are made from an elastomer.

In one embodiment, the base is hollow and has a plurality of ports, each port for receiving the lowermost ball of a column in a unit and including an opening allowing each of said lowermost balls to be directly fluidly connected to the primary fluid reservoir. Preferably, a port provides a spherical support surface, to support at least a part of the ball received therein. Conveniently, the base further comprises a reservoir charging port through which the primary fluid reservoir may be charged with fluid, the charging part having a one-way valve to substantially prevent the flow of fluid out of the primary fluid-reservoir. Preferably, each primary fluid reservoir has an independent fluid source. Conveniently, the fluid source is a primary conduit.

In one embodiment, the body support platform comprises one or more modules, each module comprising a plurality of units. Preferably, the body support platform comprises one or more trays, wherein the or each tray receives a respective module.

In one embodiment, each base further comprises at least one vent to enable the distribution of ambient air between the columns of the units. Preferably, the body support platform comprises a fan connected to the at least one vent.

In one embodiment, the body support platform further comprises a plurality of actuators, each actuator being arranged to reciprocally move a respective column perpendicularly to the body support surface and being located at the end of said column that is distal from the body support surface.

In one embodiment, the body support platform further comprises pressure sensors for sensing pressure applied to the body support surface, including a control unit for controlling the actuators depending upon signals from said pressure sensors.

In one embodiment, the body support platform includes a user interface to allow a user to select a body support platform active program, wherein said control unit is adapted to control said actuators in accordance with said program.

In one embodiment, the body support platform further comprises a ventilation system for providing ventilation through said support surface and a control system for controlling said actuators and said ventilation system including a user interface to allow a user to select ventilation conditions and support surface tactile conditions, and for controlling said actuators and said ventilation system depending upon the user's selections. Preferably, said control system is adapted to monitor the condition of said actuators and includes an interface to the Internet to enable remote monitoring of the condition of said actuators and said ventilation system.

In one embodiment, the balls include sealable inflation inlets to enable their adjustable inflation by an inflation mechanism. Preferably, the body support platform further comprises an inflation means for supplying gas to the balls for the inflation of the balls.

Conveniently, said inflation means is adapted to inflate the balls to different pressures. Advantageously, wherein said inflation means is adapted to inflate the balls in different balls, columns, modules or units to different pressures.

Conveniently, said bed can include additional components including actuators for providing a tactile experience at a support surface of the body support platform, a ventilation system for providing ventilation at the support surface, and a control system for controlling said actuators and/or said ventilation system, and an interface system for interfacing to external devices.

Another aspect of the present invention provides a bed, comprising a plurality of body support members providing a support surface; a plurality of actuators for actuating said body support members; and a control system for controlling said actuators in response to at least one of a wake up alarm, a fire alarm system, a smoke detector, a burglar alarm system and a carbon monoxide detector system and is adapted to control said actuators to generate a warning vibration in said support surface.

Another aspect of the present invention provides a body support platform for providing support for a human body, comprising a plurality of body support members providing a support surface; a plurality of actuators for actuating said body support members; a ventilation system for providing ventilation through said support surface; and a control system for controlling said actuators and said ventilation system including a user interface to allow a user to select ventilation conditions and support surface tactile conditions, and for controlling said actuators and said ventilation system in dependence upon the user's selections.

In one embodiment, the control system is adapted to monitor the condition of said actuators and includes an interface to the internet to enable remote monitoring of the condition of said actuators and said ventilation system.

In one embodiment, the control system is adapted to receive an input from at least one of a wake up alarm, a fire alarm system, a smoke detector, a burglar alarm system and a carbon monoxide detector system and is adapted to control said actuators to generate a warning vibration in said support surface.

In one embodiment, a plurality of beds may be provided in a dwelling (e.g. hotel) and their respective control systems networked to one another. For example, should an emergency (e.g fire, smoke, burglary etc) be detected in the localty of one bed, a notification may be sent to other networked beds such that the actuators of those beds may also be activated, to alert the occupants.

The present invention also encompasses a body support platform having a vibration unit for vibrating a body support surface in dependence upon an input from at least one of a wake up alarm, a fire alarm system, a smoke detector, a burglar alarm system and a carbon monoxide detector system. The vibration unit can for example clip onto the body support platform.

In one embodiment, the control system is adapted to control a sound system. In one embodiment, the control system is adapted to control a video system. In one embodiment, the control system is adapted to control at least one of a lighting system and a heating system to control ambient lighting and heating conditions.

In one embodiment, the body support platform comprises a plurality of columns in a base formed from a plurality of like units and/or modules; each column comprises a stack of a plurality of generally spherical balls filled with air and formed of an elastic air impermeable material; said balls in a said column are fixedly connected together; said plurality of columns are independently and removably mounted in said base so as to be resiliently movable in a reciprocating manner to form a support surface; and the parts are replaced by at least one of removing and replacing selected columns with columns having different resilience and removing and replacing selected units and/or modules.

In one embodiment, the bed can include additional components including actuators for providing a tactile experience at a support surface of the body support platform, a ventilation system for providing ventilation at the support surface, and a control system for controlling said actuators and/or said ventilation system, and an interface system for interfacing to external devices.

DETAILED DESCRIPTION OF SPECIFIC EMBODIMENTS

Embodiments of the present invention will now be described with reference to a bed. It should however be understood that the embodiments are equally applicable to any body support platform.

Figure 1:
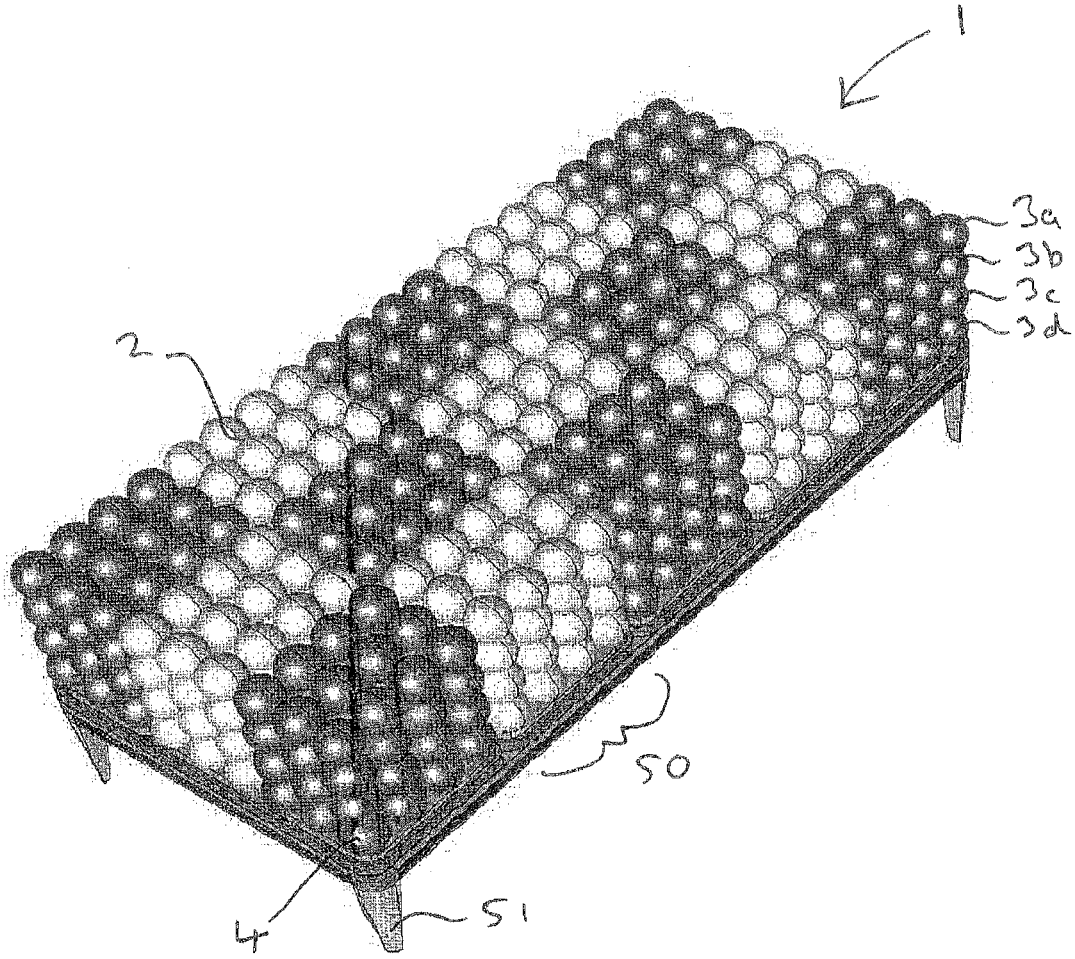
FIG. 1 is a schematic diagram of a bed embodying the body support platform according to one embodiment of the present invention.

FIG. 1 illustrates a bed 1 according to one embodiment formed from a plurality of balls 2. The balls 2 in FIG. 1 are arranged generally in four layers 3*a*, 3*b*, 3*c*, 3*d* and in columns 4. An upper surface of the uppermost layer 3*a* of balls defines a body support surface. Although in this embodiment four layers of balls are shown, any number of layers can be used. For example, an embodiment comprising columns of three balls 2 is illustrated in FIGS. 2 to 4 and 8.

As shown in FIG. 1, the bed 1 is formed of a bed frame 51 (shown in more detail in FIGS. 9 to 12). The columns 4 of balls 2 are arranged into a plurality of independent units 50. In FIG. 1, the units 50 are depicted with different shading. The construction of a unit 50 will now be described in greater detail below with reference to FIGS. 3 and 4.

Figure 2:
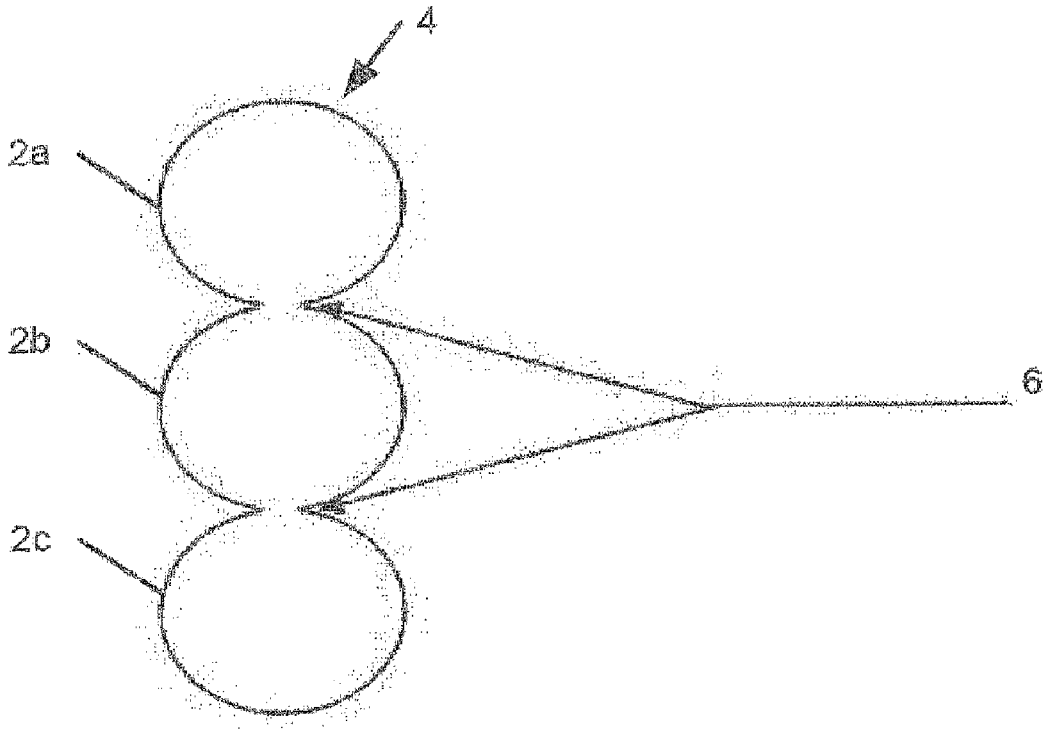
FIG. 2 is a schematic diagram of a representative column of connected balls according to one embodiment of the present invention.
Figure 3:
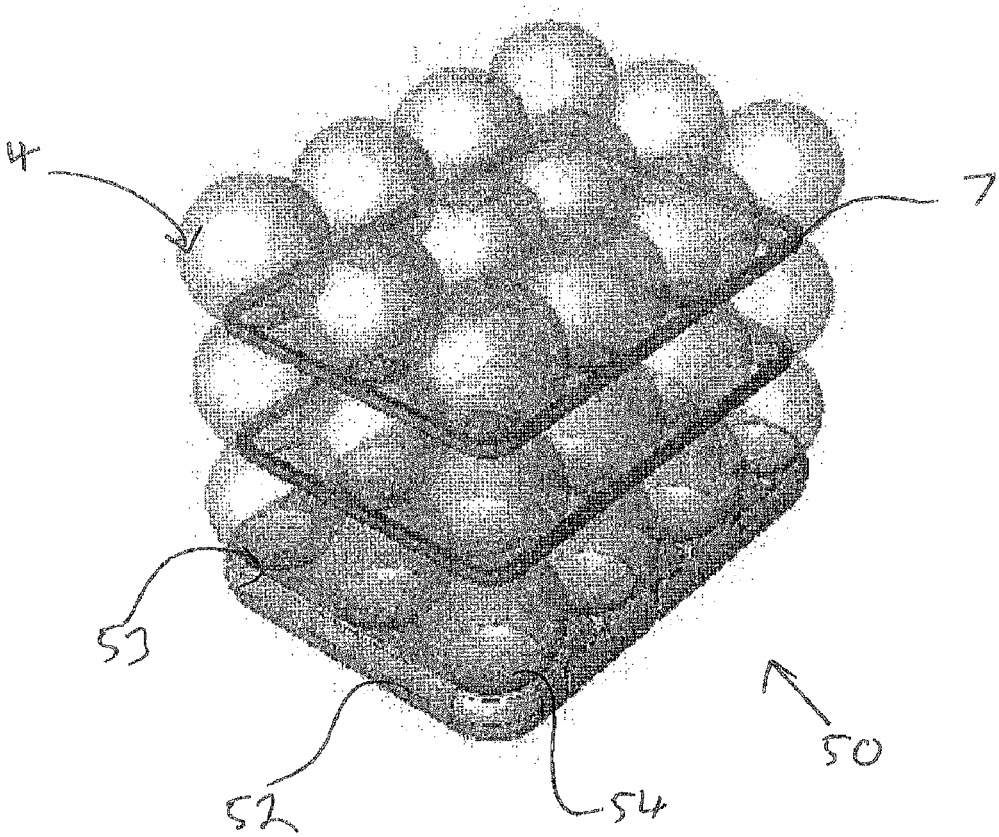
FIG. 3 is a diagram of a band provided around a unit according to one embodiment of the present invention.
Figure 4:
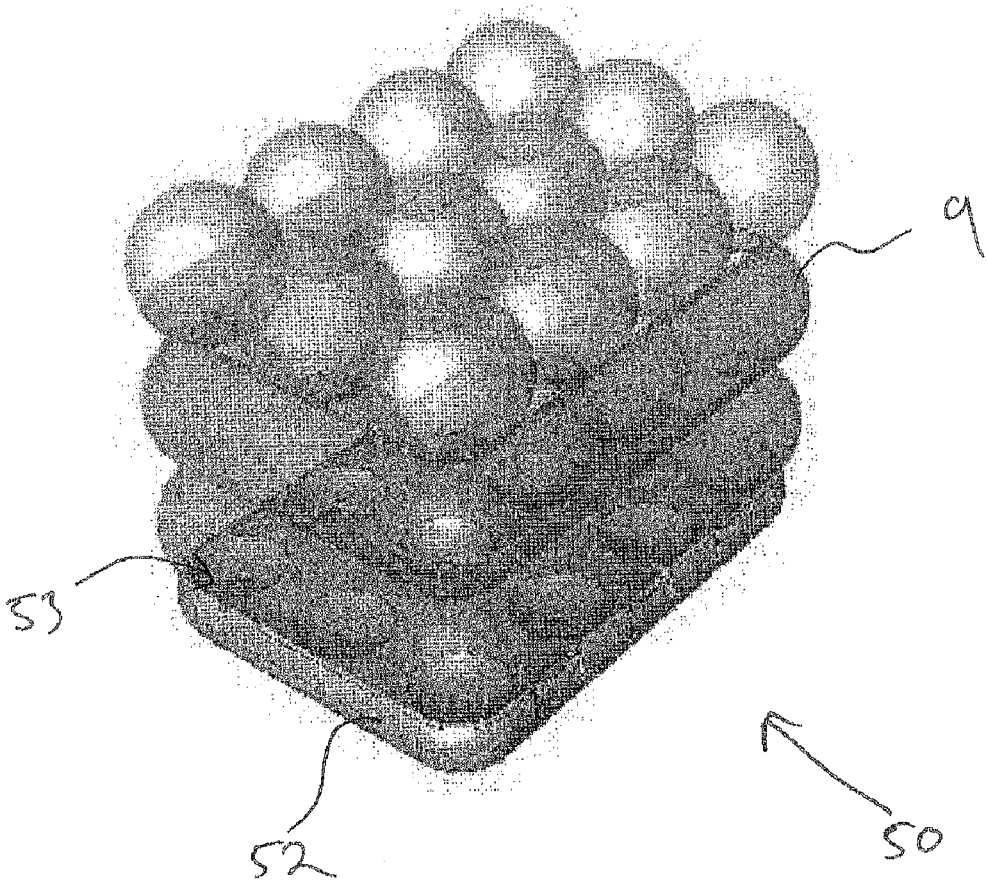
FIG. 4 is a diagram of a sleeve provided around a unit according to one embodiment of the present invention.
Figure 12:
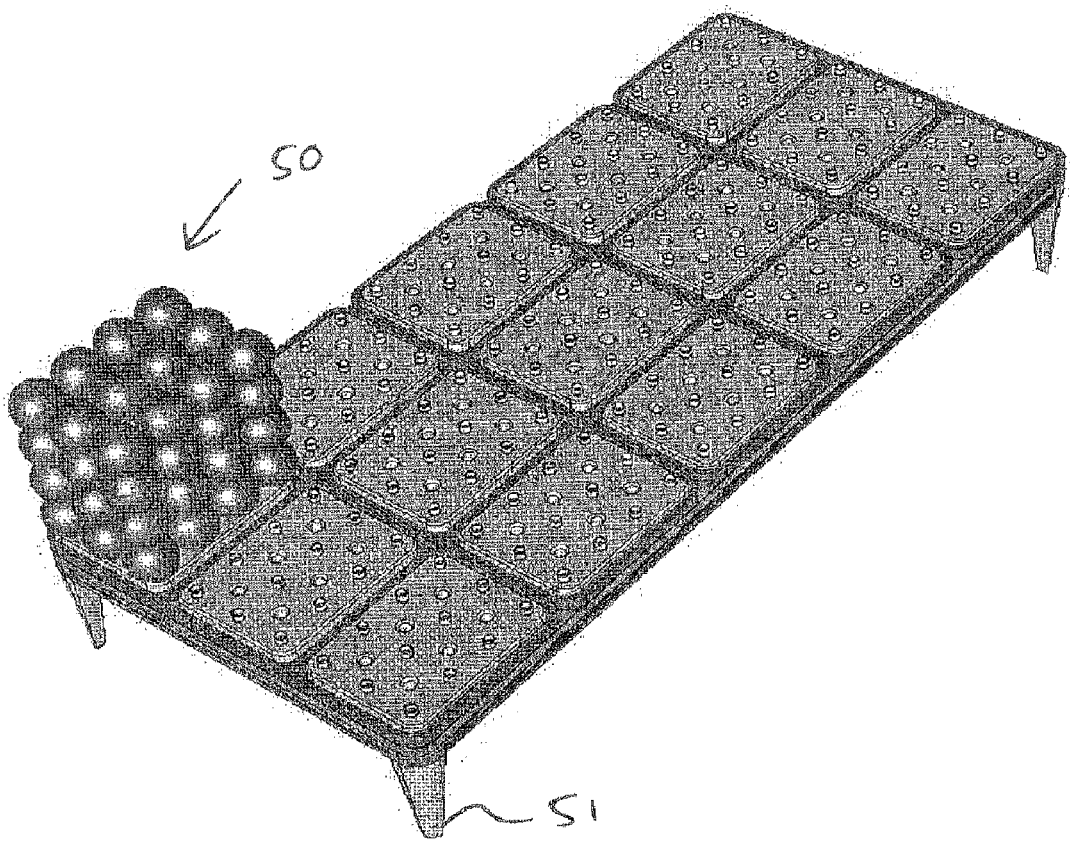
FIG. 12 is a diagram of the embodiment of FIG. 11 showing a one complete unit located on the bed frame.

Each unit 50 comprises a plurality of columns 4 of balls 2. As depicted in FIG. 2, each ball 2 of a respective column 4 is physically and fluidly connected only to the adjacent ball(s) 2 within said column 4, such that a column 4 may be compressed substantially independently of a neighbouring column 4. As shown in FIGS. 3, 4 and 12, the unit 50 comprises a base 52 which provides a primary fluid reservoir. The columns 4 are arranged in an array across said base 52; and each of said columns 4 is connected to said base 52, such that the lowermost ball 2 of each respective column 4 is directly fluidly connected to said primary fluid reservoir. Preferably, the balls 2 are arranged in a regular grid pattern across the base 52, in an N×M matrix.

The balls 2*a*, 2*b* and 2*c* can be physically connected together in any convenient fashion such as by fusing (e.g. by application of heat or a chemical), by gluing or by a mechanical fixing arrangement. They can also be connected together in a decouplable manner to allow the balls in a column to be separated and replaced e.g. using hook fastening material such a Velcro™ which requires a threshold force to decouple the balls. Each ball can thus have one or two surface regions having the decouplable material applied thereto to ensure that they can be decouplably coupled in columns without risking unwanted coupling across layers.

In one embodiment the physically fixedly connected balls 2 are individually separable using a threshold force and reconnectable to one another, to allow replacement of individual balls 2.

When the uppermost ball in a respective column 4 is compressed, the pressure of the fluid inside the ball 2 increases and fluid is caused to flow freely into the primary fluid reservoir. When the uppermost ball 2 of column 4 is compressed, the pressurised fluid is transmitted to the second ball which, in turn, is transmitted to the third ball. Subsequently, the pressurised fluid passes into the reservoir until the pressure between the column and the reservoir is balanced. Fluid will not necessarily flow into other columns 4. One benefit of this arrangement is that it promotes a balancing of pressure in the balls 2 across the body support surface. Preferably, the volume of the reservoir is far higher than the volume of an individual ball 2. The use of a reservoir substantially removes any resistance to the compression of the ball 2 or column 4. By comparison, connecting a plurality of columns 4 with a network of connecting conduits increases resistance to fluid flowing therethrough and creates back pressure.

In one embodiment, the base 52 is hollow and has a plurality of ports 53, each for receiving the lowermost ball 2 of an individual column 4 in a unit 50. Each port 53 includes an opening allowing said lowermost balls 2 to be directly fluidly connected to the primary fluid reservoir. As shown in FIGS. 3 and 4, the ports 53 comprises a spherical support surface to enable them to capture and retain said lowermost balls 2 of each column 4. In the centre of each port 53 lies an opening through which the lowermost ball (and hence the column) is fluidly connected to the primary fluid reservoir.

The lowermost ball 2 in each column 4 is preferably removably connected to the base 52. In the embodiment shown in FIGS. 11 and 12, the base 52 is provided with a bayonet spigot 54, to which a corresponding fitting on the lowermost ball 2 of the column 4 is releasably connectable. Alternatively, the column 2 could be releasably connected by means of a screw fitting, resilient fitting or other suitable means.

In one embodiment the base 52 further comprises a reservoir charging port (not shown) through which the primary fluid reservoir may be charged with pressurised fluid. The charging port preferably has a one-way valve to substantially prevent the flow of fluid out of the primary fluid-reservoir.

In one embodiment each primary fluid reservoir has an independent fluid supply connected to the reservoir charging port, to individually and selectively pressurise the reservoir and thus the balls.

Preferably, the resiliency of the balls 2 and/or unit 50 can be altered. In one embodiment, a restraining arrangement is configured to restrain ones of said columns lying around a periphery of the columns 4 so as to prevent said ones of said columns 4 from laterally moving.

In one embodiment, with reference to FIG. 3, the behaviour of a unit 50 may be altered by the provision of a band 7 around the unit 50. The height of the band 7 shown is less than the height of a ball 2 and lies in a plane substantially pararallel to the layers 3 and thus the body support surface. As shown, the band 7 is provided around the unit such that it rests between adjacent balls 2 within each outer column. Accordingly, the band 7 rests in a plane including the physical connections between respective adjacent balls of each outermost column.

In an alternative arrangement (not shown), the band 7 may be provided around the unit 50 such that it contacts the equators of the respective balls 2 of at least some of the outermost columns 4 and lies substantially in a plane including the equator of each said ball 2. In one embodiment, the band may be connected to the respective balls in the outermost columns. For example, the band may be glued to some or all of the balls. Alternatively, the equator of the balls may be provided with a connector to attach to the band. In one embodiment, the ball may comprise two spaced-apart horizontal ridges, between which the band may be held in location.

Preferably, a plurality of bands 7 may be provided around the unit 50, arranged parallel to one another. The resiliency of each band may be different. Bands of different resiliency may be provided by using different materials or bands of different thickness.

FIG. 4 illustrates another embodiment, wherein a sleeve 9 is provided around the unit 50. The sleeve 9 substantially extends across the full height of the balls in the outermost column 4. The elasticity of the sleeve 9 causes the sleeve 9 to closely follow the shape of the balls 2. In another embodiment, the sleeve 9 may be more or less than the height of a ball 2. The sleeve 9 may extend substantially across the height of the unit 50.

The band and sleeve have been described above as being provided around the outermost columns of a unit. Additionally or alternatively, the band or sleeve may be provided around fewer than all of the columns of a unit. For example, a band or sleeve may be provided around the balls of inner columns of the unit, instead of or in addition to a band or sleeve being provided around the unit as a whole.

Where two units are arranged side by side in use, the band or sleeve may be provided around at least one column of one unit and at least another column of the adjacent unit.

The behaviour of the unit may also be configured by providing balls 2 of different resiliency. In one embodiment, the resiliency of at least one ball 2 in a column 4 is less than the resiliency of the/a lower ball(s) in said column. Conveniently, the resiliency of each ball 2 in a column 4 is less than the resiliency of the ball 2 directly beneath it in said column 4.

In another embodiment, at least one ball in a column is made of a different material to that of at least one other ball in said column.

In one embodiment, at least one ball in a column has a thicker wall than that of at least one other bail in said column. Accordingly, where a column is made as a unitary moulded item, the same material may be used to make all the balls, but the resiliency of individual balls is altered by providing a wall of a predetermined thickness.

In one embodiment, at least one ball in a column has a different surface texture to at least one other ball in said column to affect its resiliency.

Figure 5:
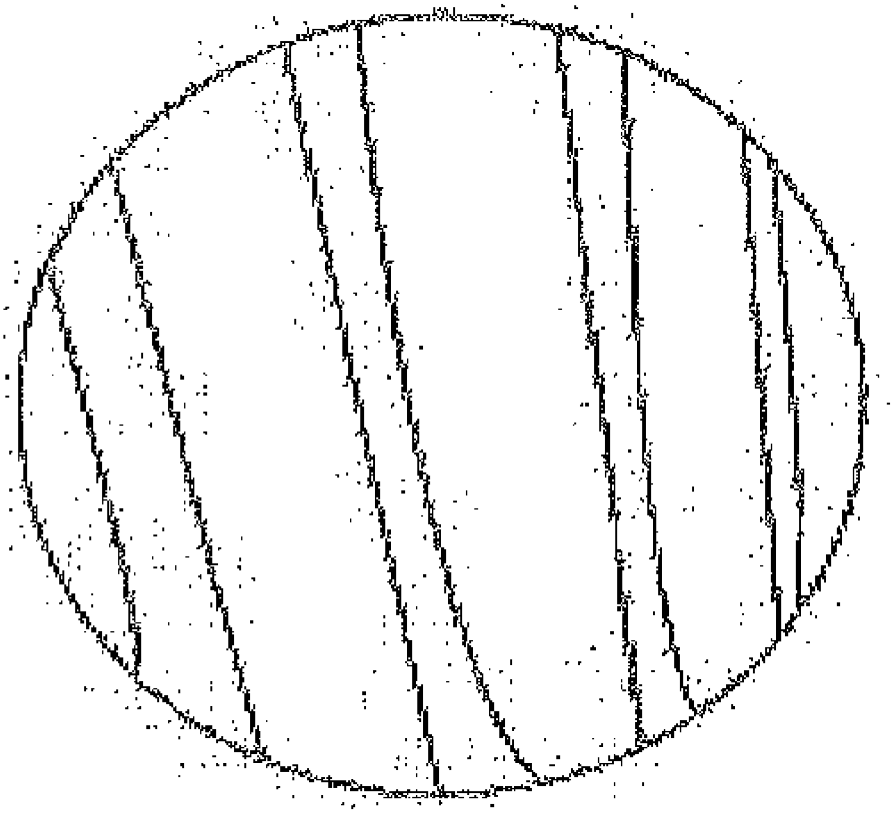
FIG. 5 is a diagram of a ball having a ribbed surface according to one embodiment of the present invention.
Figure 6:
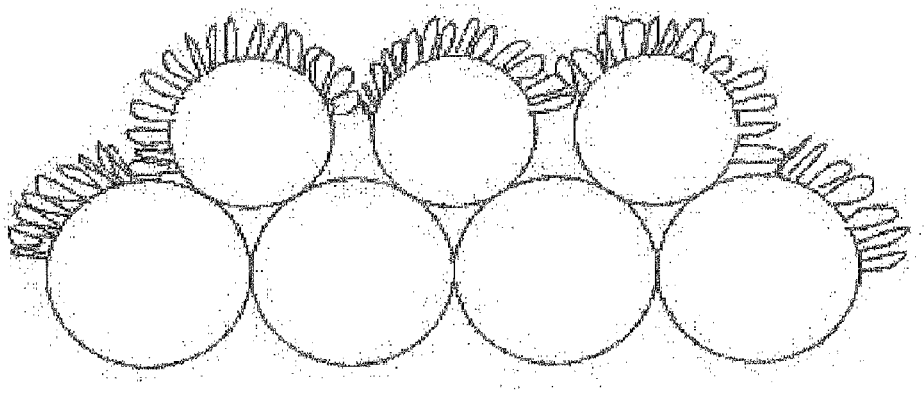
FIG. 6 is a diagram of balls having protrusions according to one embodiment of the present invention.

In one embodiment, the surface of at least one ball in a column is provided with at least one protrusion, as shown in FIG. 5. The illustrated ball is provided with ribs arranged across its surface to modify its elasticity (resiliency) in certain directions to change the characteristics of the bed. As schematically illustrated in FIG. 6, at least some of the balls e.g. balls on the top layer, may be provided with protrusions to change the feel of the body support surface.

Preferably, the balls in the lowermost row 3 are the most resilient, offering a firm base. The balls in the row 3 above are less resilient. The balls in the rows above are progressively less resilient. The balls in the uppermost row are thus the least resilient. Overall, such an arrangement provides a body support platform having a progressively resilient reaction to a person resting on the platform.

As illustrated in FIGS. 3 and 4, the columns 4 of balls 2 are connected to a moulded base 52 which provides a firm support structure. As well as providing ports 53 for fluid connection to each of the columns 4, the moulded base 52 preferably includes ventilation conduits (not shown) for the passage of ventilation air therethrough from a ventilation source to a ventilation port 55 (see FIGS. 11 and 12). The air can be forced into the bed by an external fan arrangement or by the incorporation of one or more local fans.

In one embodiment, the body support platform includes one or more modules, each module comprising a plurality of the independent units described above. In the embodiment shown in FIGS. 1 and 10 to 12, the modules each comprise three units, arranged across the bed frame.

Figure 10:
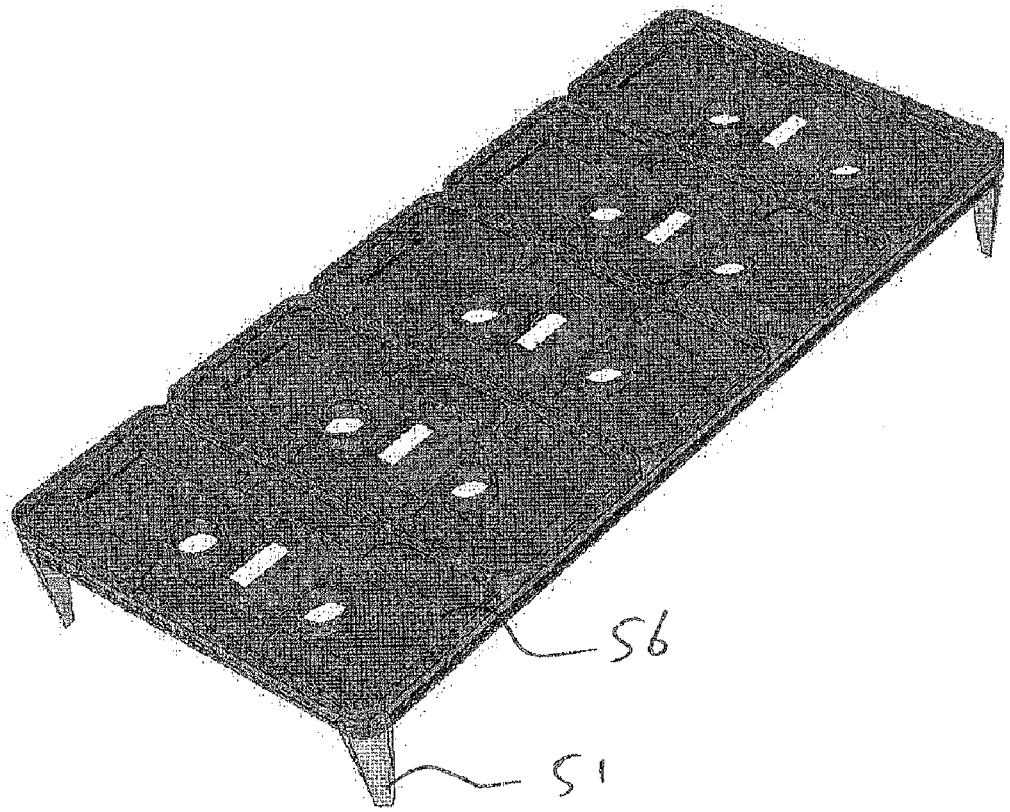
FIG. 10 is a diagram of the bed frame of FIG. 9 provided with a plurality of trays.
Figure 11:
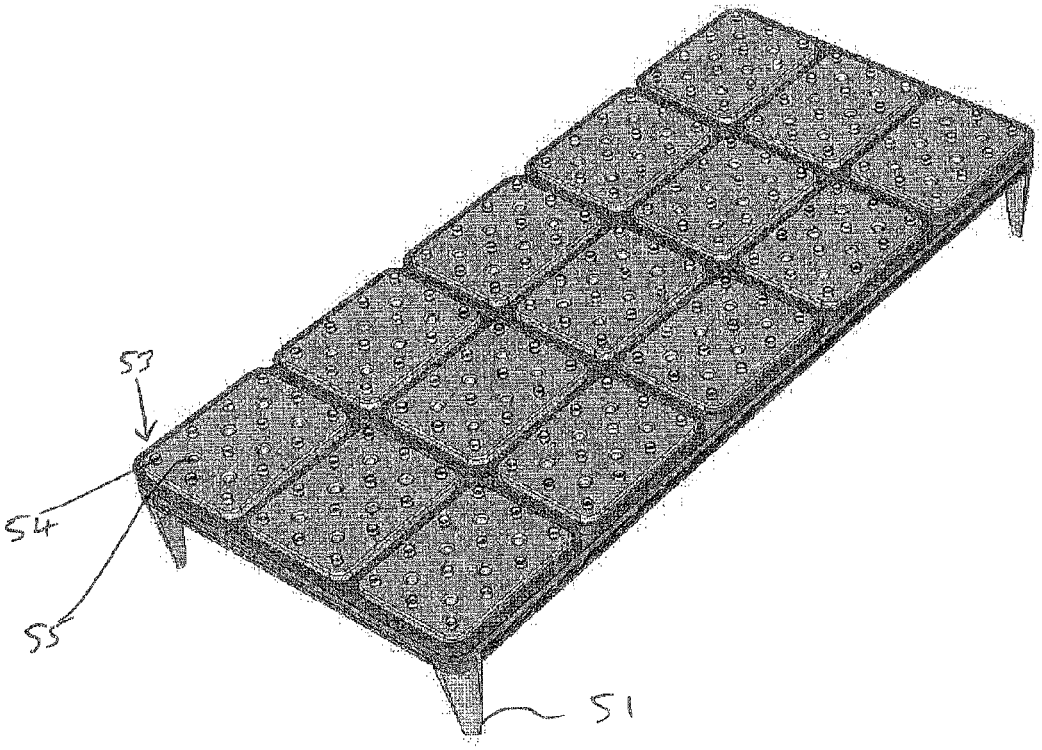
FIG. 11 is a diagram of the embodiment of FIG. 10 showing the positioning of the bases of the units (shown without columns)

Each module (i.e. a set of units) is received in and supported by a tray 56, as shown in FIGS. 10 and 11. Each tray 56 is removably receivable in the bed frame 51, and the trays 56 are arranged side-by-side in abutting relationship. The trays 56 may be optionally secured to the bed frame in use, to prevent dislodgement.

A plurality of units 50—three in this embodiment—are received in the tray. The respective bases 52 of the units mounted on the tray are arranged so as to abut one another. Conveniently, the outermost columns in a unit abut those of an adjacent unit. Conveniently, the outermost columns of adjacent units are spaced the same distance from one another as the columns within the same unit. The units therefore collectively define a continuous body support surface with no appreciable gaps.

The above described bands or sleeves may equally be provided around the module, rather than each individual unit. Likewise, the bands or sleeves can be provided around the body support platform as a whole.

In one embodiment, fluid may be provided to the primary fluid reservoir of each base directly from a common fluid source. Accordingly, a network of primary fluid conduits may be connected at one end to the reservoir charging port, and at the other end to a fluid distributor on the primary fluid source. Flow valve actuators may selectively control the supply of fluid to each unit.

In another embodiment, each module may provide a local fluid source. For example, a local fluid source may be provided in each tray, operable to provide fluid to only the units within the module. Conveniently, the supply of fluid can be isolated within each module, to the user's requirements.

In one embodiment, a ventilation system may be provided. For example, a vent may be provided on each base (as described above), to which either a central or local ventilation pump is connected.

In one embodiment, each tray is provided with a pressurised fluid supply pump for the reservoir of each unit, and a ventilation fluid supply pump.

The balls used in the bed are formed of washable material to facilitate easy cleaning of the bed. The balls can also be colour coded to indicate their intended fluid pressure and/or their elasticity.

The decouplable nature of the bails enables the bed to be made in a modular manner and on a ball by ball or column by column basis. The columns can be prefabricated by, for example gluing the balls into stacks. The bed can then be fabricated by assembling columns having balls having the appropriate gas pressure and elasticity to meet the customer's requirement.

Figure 8:
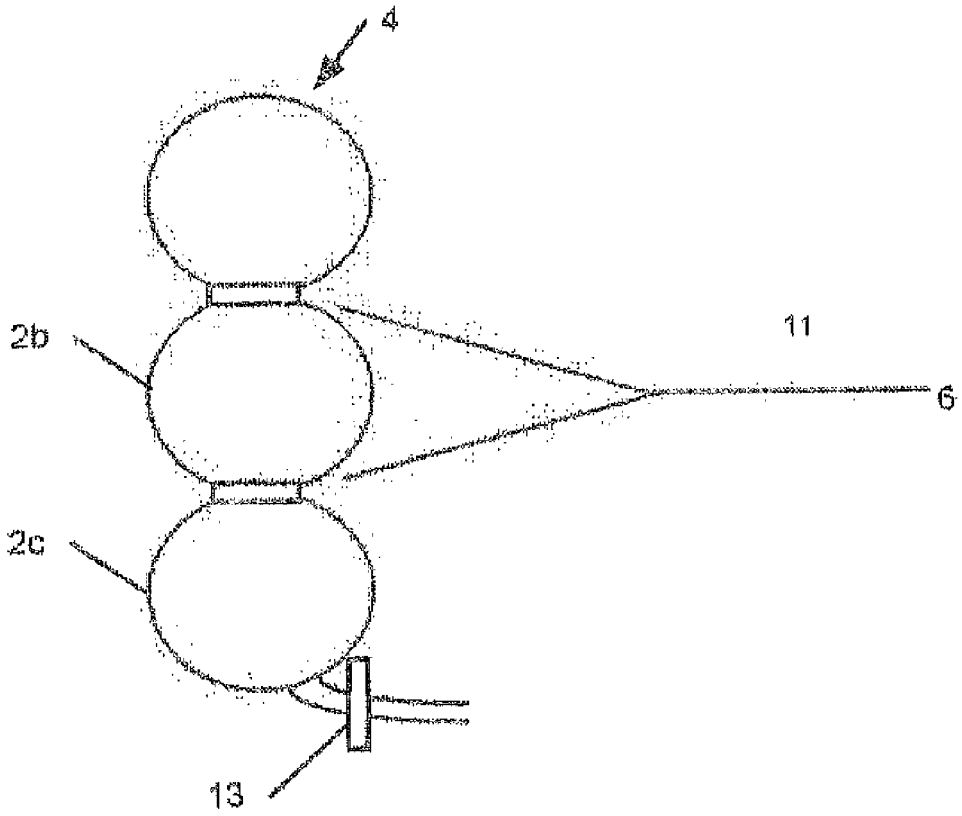
FIG. 8 is a diagram illustrating the use of air fill clips for controlling the filling of air into the balls of a column according to one embodiment of the present invention.
Figure 9:
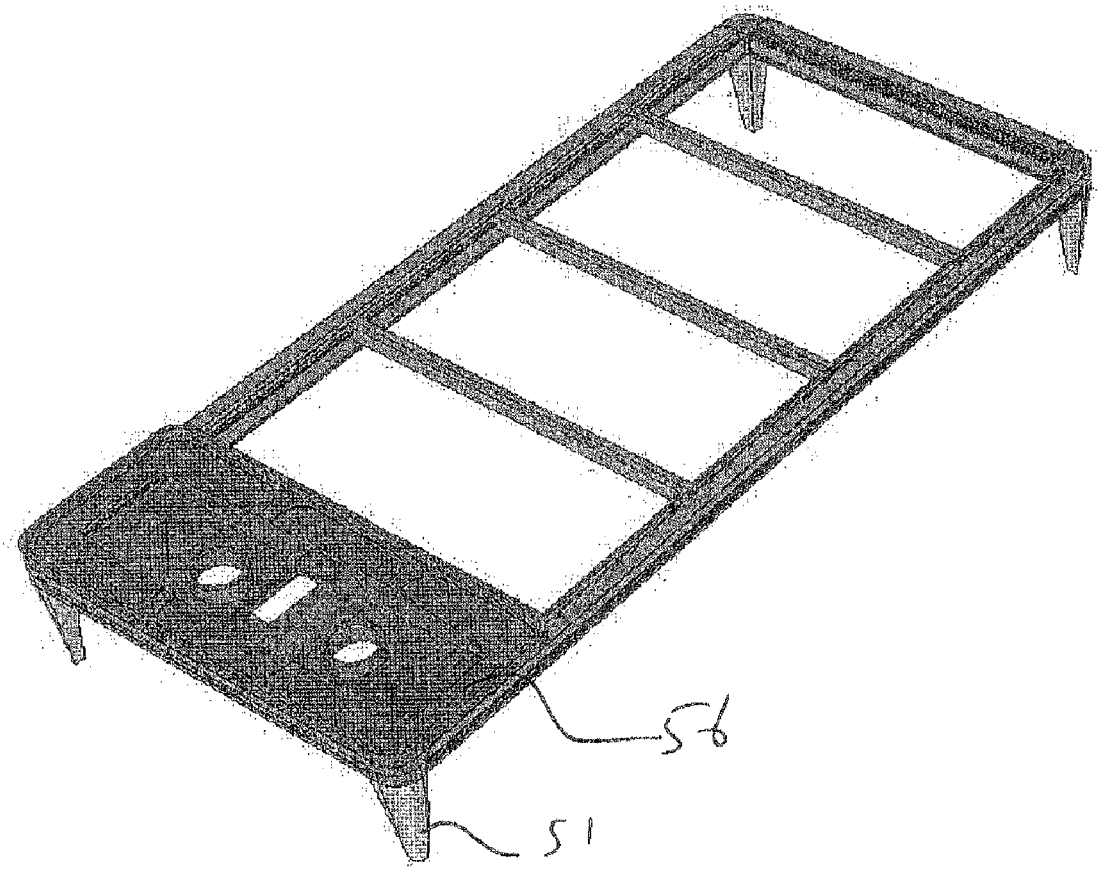
FIG. 9 is a diagram of a bed frame and tray of one embodiment of the invention.

The connection points between balls can be provided so that a first set of balls can be inflated to a first pressure and then isolated. A second set of balls can then be inflated to a second pressure and then isolated and so on. FIG. 8 illustrates valve mechanisms or clips 11 that may be used between balls 2*a*, 2*b*, and 2*c* in a column 4. An inflation port 11 is provided on the lower ball 2*c* with an isolation valve 13 and hence the upper ball 2*a* can be inflated and isolated first, then the middle ball 2*b* and finally the lower ball 2*c*. This process can be used during manufacture and post sale modification, refurbishment or maintenance.

Where an 'active' bed is required, actuators can be provided at the base of each column. The actuators may comprise piston like devices that can provide reciprocal motion or force. Such actuators can be provided in place of at least certain ones of the lower layer of balls.

Figure 13:
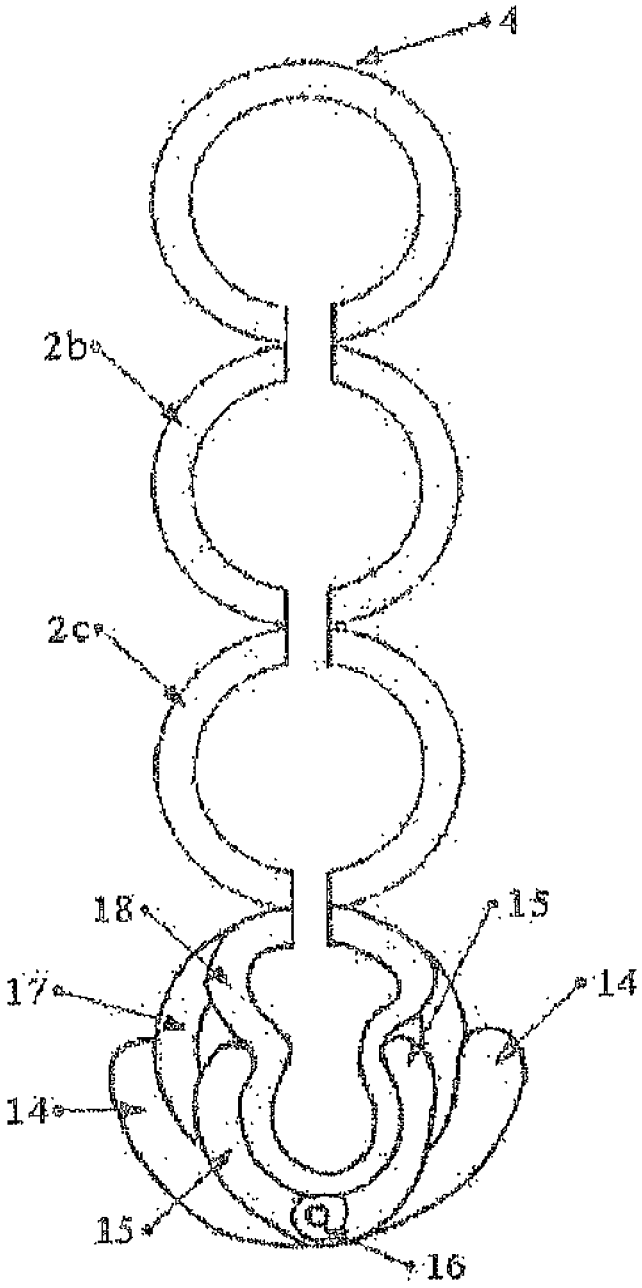
FIG. 13 is side schematic view of one embodiment of the present invention with a lower sphere cup like actuator.

FIG. 13 shows a cup like lower sphere actuator 13 in an open position and in a closed position 14. The lower sphere is shown in balanced gas pressure with upper spheres 16 and under compressed pressure in deformed shape 17. The said cup like actuator has a central pin pivot 15 to provide a claw like compression movement. This action will force the inner gas shared by all the connected spheres upward to provide greater internal pressure for the upper spheres to provide a firmer support for a specific section or for the entire sphere mattress.

In another embodiment, the function of the actuator can be replicated by alternating the pressure provided by a fluid source to the balls of a unit between two predetermined pressures. For example, the fluid source may repeatedly increase and decrease the pressure of the fluid supplied to the balls of the unit, to gently massage or alert the user. Where a plurality of units are provided in a module, and the module is provided with a single fluid supply, the pressure in all the balls of all the units may be adjusted as described. Where a bed is provided with a plurality of modules, the pressure in each the modules (i.e. the units in the module) may be adjusted/alternated independently.

Figure 14:
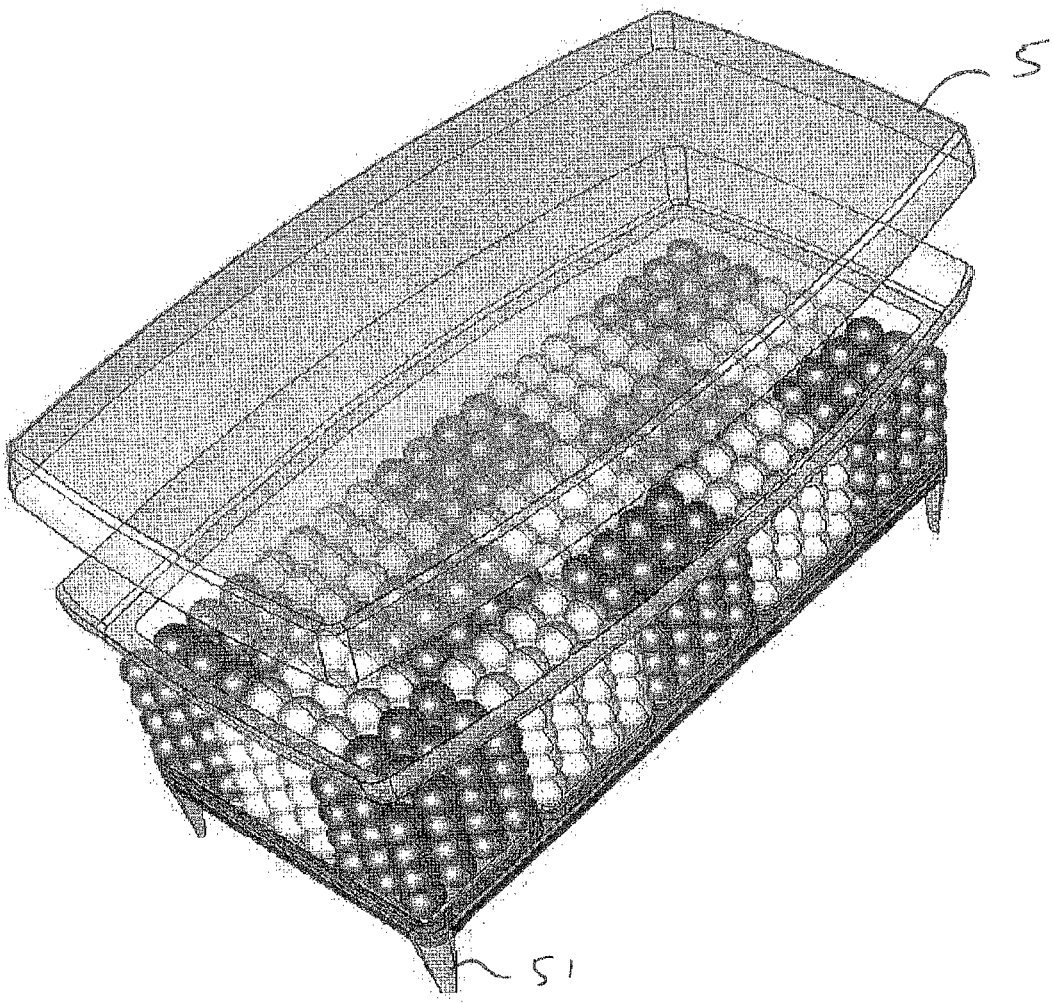
FIG. 14 is a schematic diagram of the bed of FIG. 1 with a cover.

FIG. 14 illustrates the bed of FIG. 1 provided with a cover 5. The cover 5 can provide a soft top covering on the body support surface and can additionally act to contain the structure. The sides of the cover 5 can act to assist with restraining the balls to keep them from bulging outwards when in use. The cover can be made of a stretchable fabric to allow free movement of the ball columns. Ventilation holes can be provided in the top surface over the body support surface to allow for air to exit through the body support surface to provide ventilation for the user. Preferably, the side walls of the cover are air (fluid) impermeable. Accordingly, in an embodiment where ventilation air is circulated between the columns, the air is caused to escape only through the body support surface, rather than out of the sides of the body support platforms.

Figure 15:
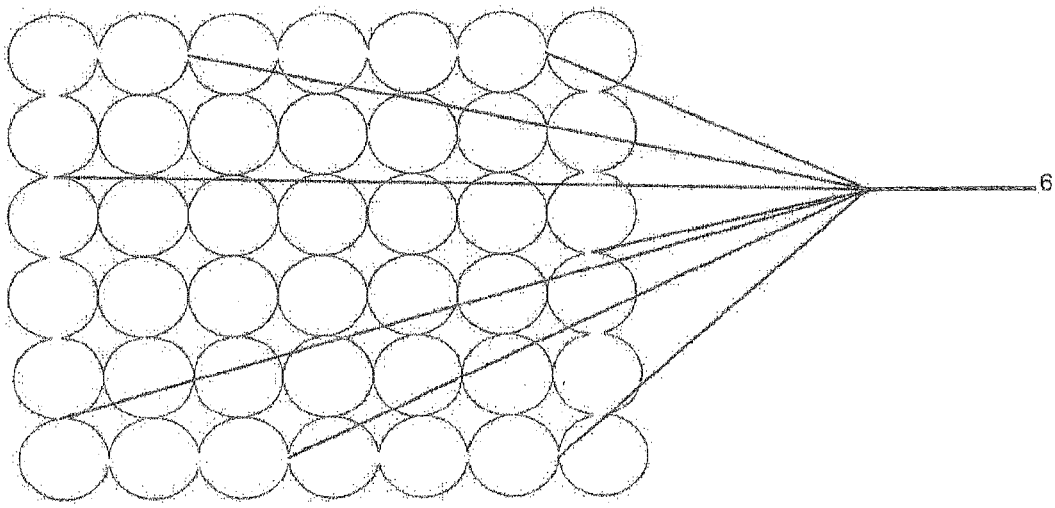
FIG. 15 is a schematic plan view of a support surface of a body support platform showing the connection of balls of adjacent peripheral columns according to one embodiment of the present invention.

FIG. 15 is a schematic plan view of the body support surface and illustrates how adjacent balls in the top layer around the periphery of the bed may optionally be coupled together to keep the shape of the bed. The coupling 6 can be of the same form as between balls in the columns 4. The coupling of the balls in the top layer around the periphery of the bed assists in keeping the shape and preventing columns from displacing out of the side of the bed.

Figure 16:
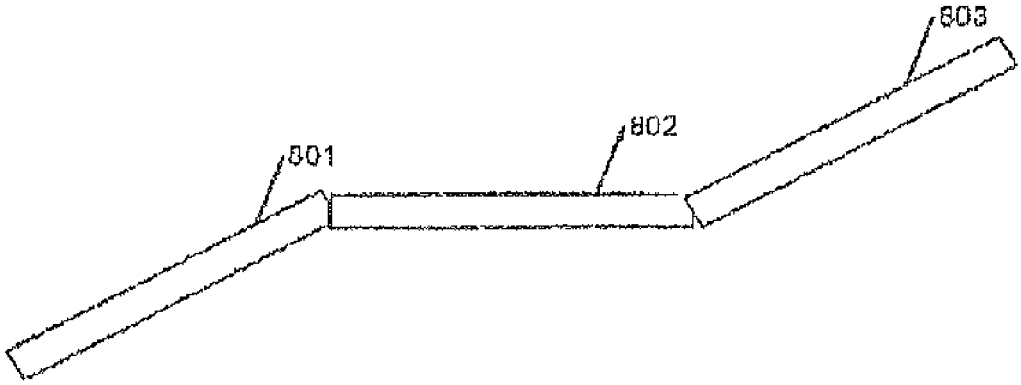
FIG. 16 is a side schematic view of a bed of one embodiment of the present invention in which modules can relatively rotate.

FIG. 16 is a schematic side view of a bed having modules (or units) 801, 802 and 803 that are relatively inclinable. A bed position controller can be provided to drive and control actuators for the three modules 801, 802, and 803 to control the height and configuration of the bed. The modules 801, 802 and 803 are relatively hinged to allow their relative inclination. Although this embodiment illustrates three modules, any number of such modules can be linked in the same manner to be relatively inclinable.

Figure 7:
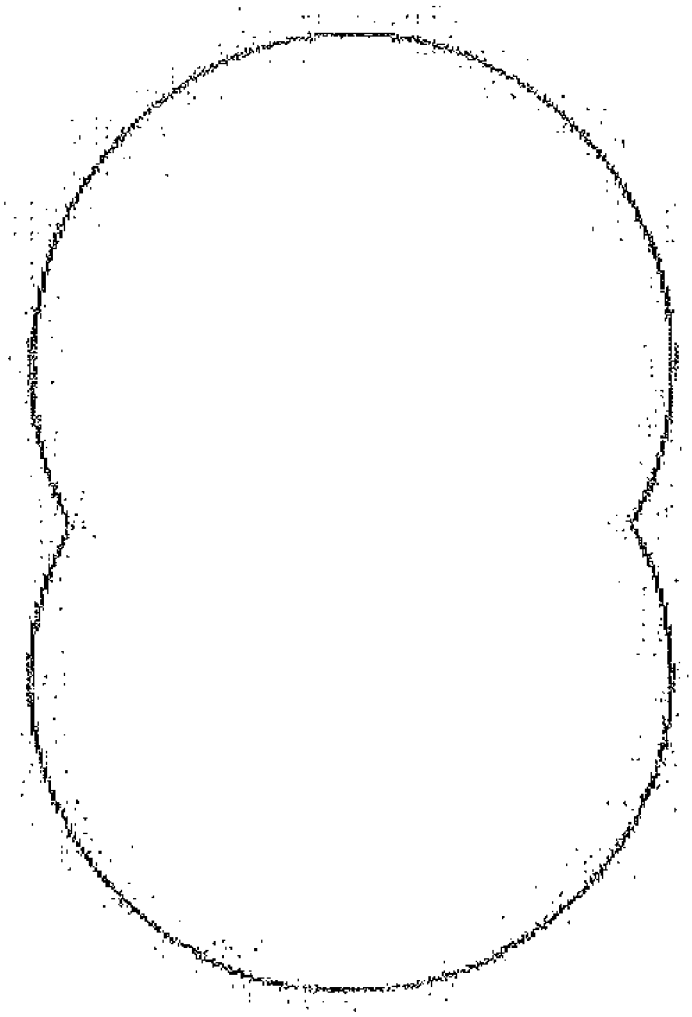
FIG. 7 is a diagram of an elongated ball according to one embodiment of the present invention.

The balls are generally spherical since this is the shape that provides the best characteristics. This should be interpreted not in a true geometrical sense but in a functional sense in accordance with this invention and this includes shaped with multiple surfaces which are near spherical as well as extended spherical shapes such as illustrated in FIG. 7.

Figure 17:
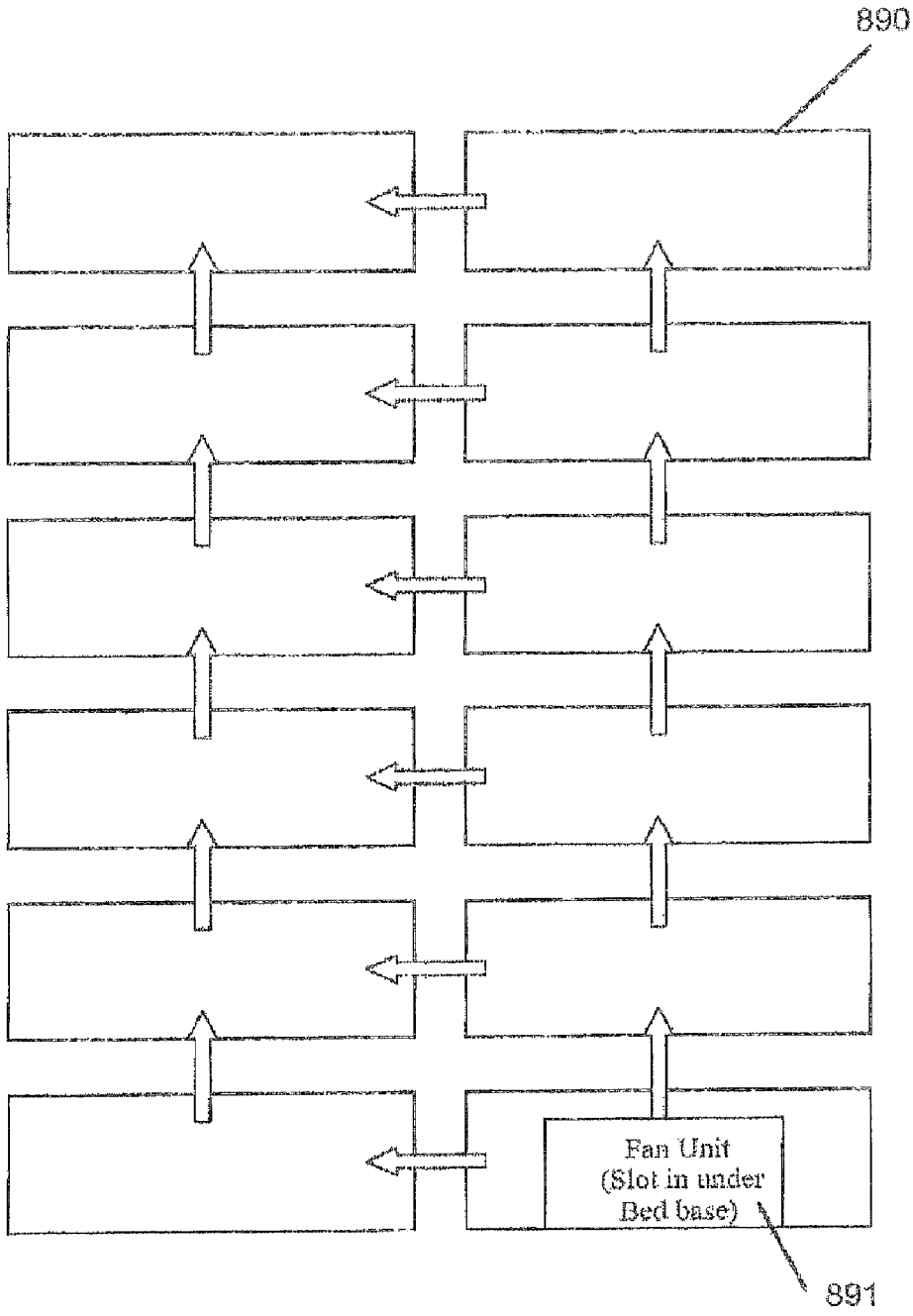
FIG. 17 is a schematic diagram of the ventilation system in a bed in accordance with one embodiment of the present invention.

FIG. 17 is a schematic diagram illustrating an airflow arrangement in a bed 899 in accordance with one embodiment of the present invention. Modules 890 are interconnected with airflow interconnections to allow air to flow freely through the whole base. A ventilation unit 891 is provided under a module in a corner of the bed 899 and the arrow indicate the direction of airflow through the base to provide the air in each module for the ventilation of the support surface of each module. The ventilation unit can provide a flow of air at a controlled airflow, temperature, and humidity and even scented.

Figure 18:
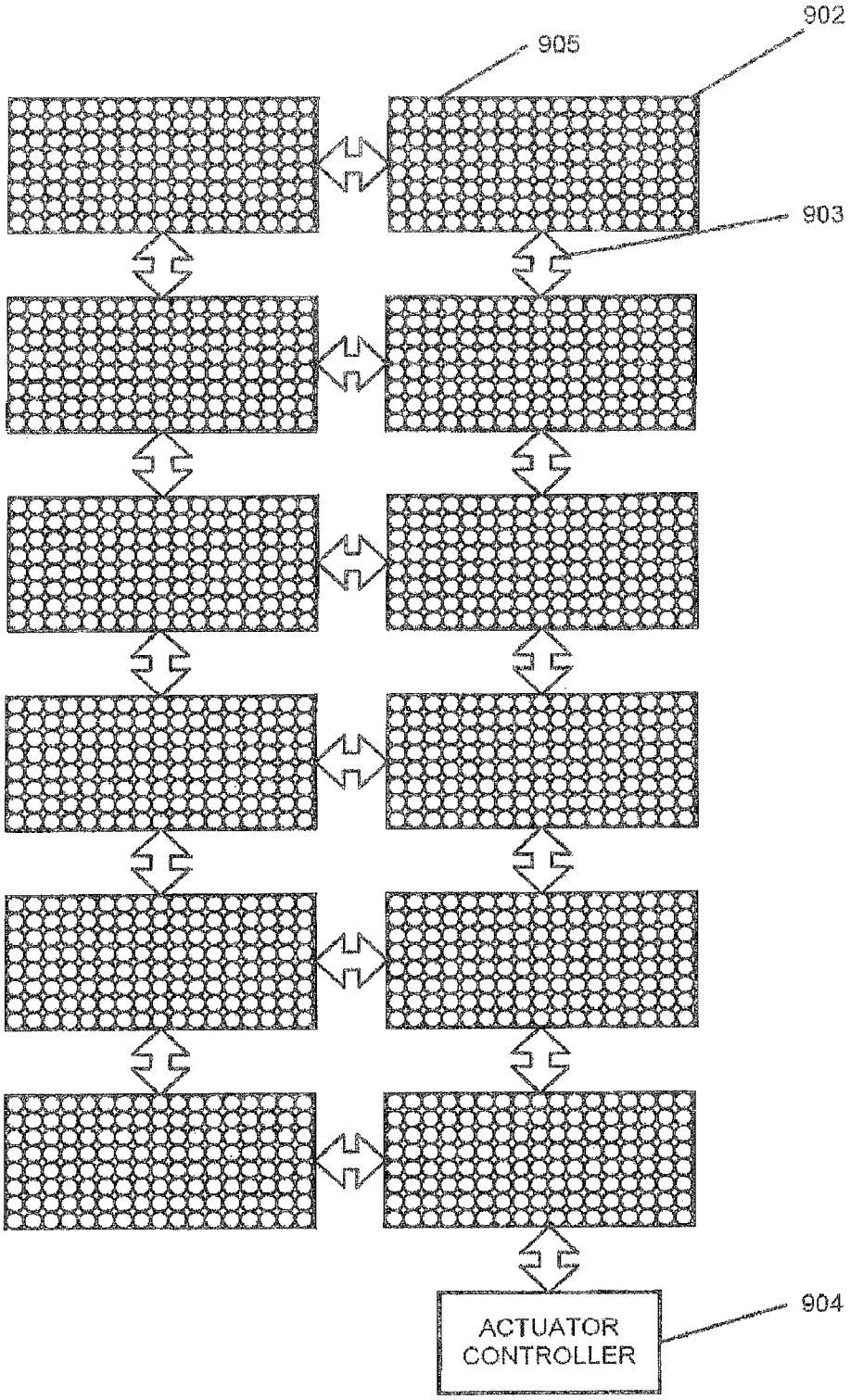
FIG. 18 is a schematic diagram of the actuation system including the actuation controller in accordance with one embodiment of the present invention.

FIG. 18 is a diagram illustrating the actuator layout and control in a bed 901. The bed is formed of a plurality of modules 902. Each module 902 comprises a plurality of columns each having an actuator 905 underneath or on top thereof. Each module is interconnected and electrical connectors 903 are provided to provide power and control signals to each actuator 905. An actuator controller 904 is provided under a module such as in a corner or near a head end of the bed 901. The actuator controller provides the power and control signals to control the actuation of each actuator. The actuator controller 904 will also receive any feedback signals from force or pressure sensors associated with each actuator 905.

In this way the actuator controller 904 is able to control the actuators to provide a tactile experience to a user on the body support platform. The actuator controller 904 can receive program instructions from a computer based on selections made by a user as will be described in more detail hereinafter.

For maintenance purposes, each actuator can be monitored by the actuator controller 904 and/or can generate a monitoring signal to indicate the state of the actuator. In this way the actuator controller 904 can run a maintenance program to determine when maintenance intervention is required.

Figure 19:
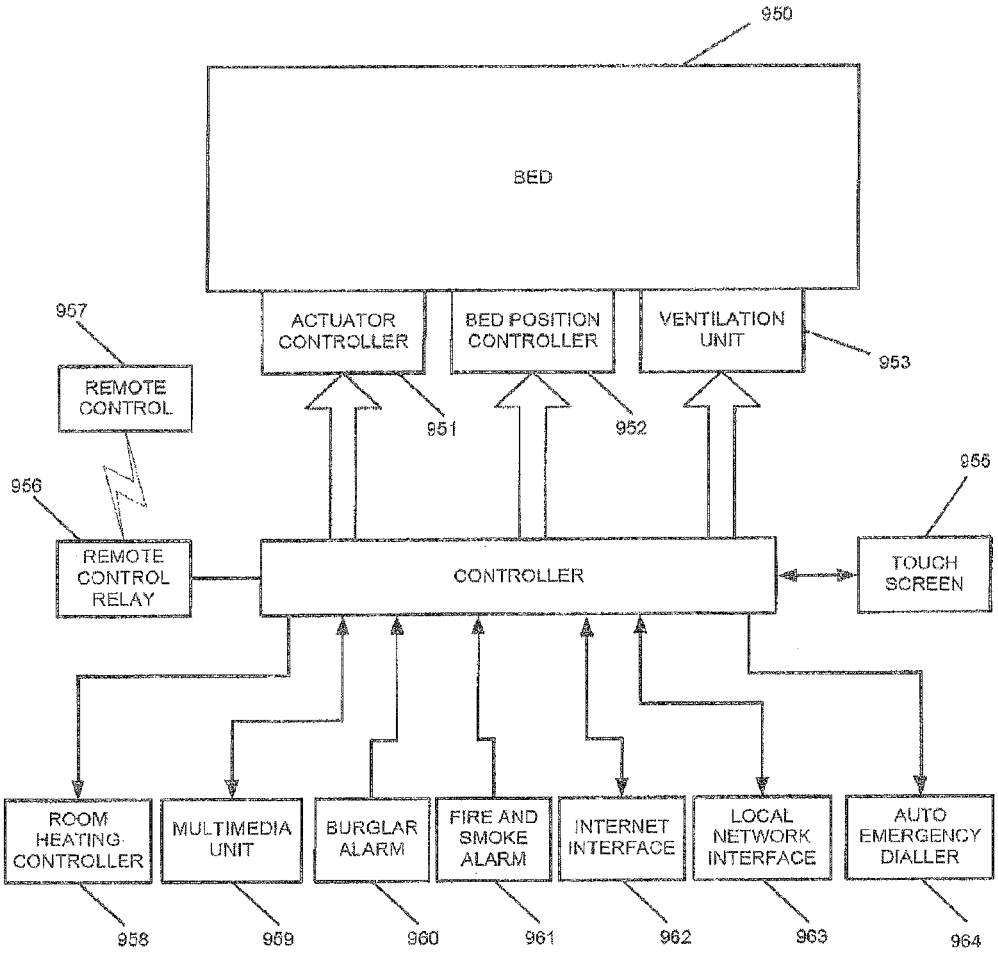
FIG. 19 is a schematic diagram of a control system for use with the bed according to one embodiment of the present invention.

FIG. 19 illustrates the control systems for controlling the bed and ancillary functions to provide the user with a pleasant and relaxing experience.

The bed 950 is provided with an actuator controller 951 for controlling the actuators under each column as described with reference to FIG. 14, a ventilation unit 953 for controlling the flow and temperature of the airflow to the modules as described with reference to FIG. 13, and a bed position controller 952 for controlling the height and configuration of the bed as described with reference to FIG. 12.

A computer acting as a controller 954 provides overall control of the activation controller 951, the bed position controller 952 and the ventilation unit 953 in accordance with external parameters and selections made by the user using a user interface such as a touch screen 955 or a remote control 957 which communicates with a remote control relay 956 connected to the controller 954. External parameters can be input from a multimedia unit 959, a burglar alarm 960, a fire and smoke alarm 961, an internet interface 962, and a local network interface 963. The controller can output signals to external devices such as a room heating controller 958, the multimedia unit 959, the internet interface 962, the local area network interface 963 and the emergency dialler 964. In this way a user is able to control the environment on the bed and in the vicinity and to externally communicate.

A user can thus control the multimedia unit 959 to listen to music or view videos and to control the actuation controller 951 to control the actuators provide an active suspension experience synchronised to the music or video. Multimedia content can also be downloaded from the Internet or local area network.

The user interface allows a user to select to control the actuation controller 951 to provide a massage. The massage program can be chosen for medical or leisure purposes.

The controller 954 can control individual platform members, to enable them to be synchronised to oscillate to sound, digital moving images, massage or other entertainment, or therapeutic programmable software files.

The controller 954 can control the ventilation unit, platform segment position adjustment and a full media centre with the touch screen to control and monitor the body support platform, watch TV and link to the Internet. The controller 954 can accept SD cards or any other form of digital or magnetic programmable input media. The controller 954 can link to the internet wirelessly or via cable for downloading music, video and massage programmes, and to allow remote monitoring maintenance of the body support platform and its components.

The fire and smoke alarm 961 is linked to the controller wirelessly or via cable to alert a user of smoke or heat detection by activating the actuators to oscillating support surface. A pre recorded message can also be played to guide users to follow safety or escape instructions. The emergency dialler 964 can then be controlled to call any emergency services or any private response.

The controller 954 can be linked to other home computers or networks via the internet or local area network to synchronise with calendar software, to alert the user to appointments using an onboard audible and suspension oscillating alarm system.

The controller 954 is also linked to a burglar alarm 960 wirelessly or via cable to alert a user of burglar detection by activating the actuators to oscillating support surface. The emergency dialler 964 can then be controlled to call any emergency services or any private response.

Since the controller 954 is connected over the internet, the ventilation unit 953 can be controlled remotely to warm up the bed.

Each column may be independently actuated, and each actuator may be independently controlled by a processor running a computer program or a set of instruction code. The computer program or instruction code may be supplied on a data carrier such as a CD-ROM, floppy diskette or solid state memory device, or may be downloadable as a digital signal from a connected personal computer, or over a local area network or a wide area network such as the Internet. Alternatively a processor arranged to execute the processing steps may be hard coded to implement the program.

Each column may be moved up and down, any distance (within the amount of travel available to the column), at any speed (within the limits of the actuators) and in any time sequence or pattern. Thus, the columns may be made to oscillate in waves or other predetermined patterns, inter alia for medical purposes, therapeutic purposes, relaxation or entertainment.

Two dedicated control software packages are envisaged: one for medical treatment or physiotherapeutic recuperation, and the other for leisure or entertainment. The processor may be linked to audio and/or video sources, such as a CD player, DVD player, or another audio, visual, audio-visual or multimedia player. The software is operable to synchronise the movement of the body support platform to any media signal, in a similar method to that which is currently used to synchronise disco lights to music. Alternatively, bespoke software can be provided to analyse a given melody and/or rhythm and to create a suitable pattern of actuation of the columns. Control data files, which are preconfigured to provide specific patterns or rhythms of actuator movement, may also be downloaded from a website or obtained via a data carrier or network.

Software may also be provided to link the motion of the body support platform to computer games and MP3 files etc. Software may also be input via media storage cards, solid state memory devices, smartcards, mobile hard dives such as Pods, and so on.

The body support platform may be powered using mains electricity, but can also run using a rechargeable battery back up, kinetic, EAP or solar electric energy generating methods.

The functions of the body support platform can be controlled using the touch screen 955, which can be wirelessly connected to the controller 954. The screen can be mounted on a moveable arm, so that it can be brought around from the side of the body support platform, to in front of the user. A wireless screen provides a more elegant overall piece of apparatus, and is also easier to move into place (or to put to one side) when necessary. The screen may be actuated using position sensors or other devices such that it always faces the user in use.

The visual display 955 is under the control of the controller 954, and is operable to provide a user interface environment by which the user may control one or more of the functions of the body support platform (including movement, and/or the speed or temperature of ventilation/airflow through the platform), lighting, and any associated devices such as music players, video players, and other audiovisual or multimedia equipment. Preferably user input is received via the touch sensitive screen, although other input devices such as buttons, a keypad or keyboard, and/or a mouse or trackball, etc., may also be employed. A voice activated system could also be used to control the functions of the body support platform.

The touch screen may be configured to automatically move away if/when the user falls asleep. Sensors may be provided to sense when the user has fallen asleep, or this may be deduced from the movement on the user on the body support members.

The controller 954 may be operated to cause the platform members to move or oscillate according to one or more predetermined programs. For example, a massage program may be run, to relax stiff joints and muscles, or alternatively a therapeutic program may be run, to benefit those suffering from medical conditions, or to help the user get to sleep, or to massage the user gently whilst he sleeps. Alternative programs may be run for entertainment purposes. The platform members may move or oscillate in time to music or moving images displayed on the visual display. This may help the user to relax, or to get to sleep. It may also be of use in therapeutic applications, or for entertainment. The provision of ventilation through the body support platform may help treat patients in hospital, and is also of benefit to domestic or commercial users.

A medical practitioner may supply a patient with one or more movement programs (e.g. for physiotherapy), and/or static platform configuration data, on a smartcard or other portable data carrier. The patient can then take the program(s) home with him and run them on a body support platform at home. Likewise, a user can save his preferred programs on a portable data carrier, and can take them with him to a hotel, whereupon the programs can be transferred and run on a body support platform in the hotel (which may be the user's hotel bed).

The touch screen may be further operable as a television, or for use in playing computer games, or interacting with any other processor-based equipment.

In alternative embodiments, the visual display may be provided by an overhead projector, arranged to project digital images onto the ceiling above the user, or onto the wall in front of the user. The images projected may include moving images synchronised with the motion of the platform members, alarm images (if used in connection with a fire, smoke or burglar alarm, as described below), or any other images.

The advantages of the controller 954 being connected to a network, which may be a wired or wireless network, a local area network, a wide area network, or the Internet is that data can be sent from the body support platform, for example for medical monitoring purposes, and data to be sent to the body support platform, for example to update a movement/oscillation program. The user's sleep or movement patterns may be monitored, which may be useful for either hospital/medical and home use, and the sleep/movement data may be transmitted to a medical practitioner if necessary.

Thus, the controller may be configured to send data from the body support platform to a remote site such as that of a medical practitioner, to enable the use and movement of the body support platform to be monitored and/or recorded. Additional medical devices and/or monitoring devices may be attached to the controller, to provide further medical functionality and monitoring capabilities, as required.

This may enable patients to convalesce at home rather than in a hospital bed, and for the patient to be monitored at home, and thereby may enable healthcare services to move patients out of hospital sooner than is currently the case. A camera may be provided on the body support platform at home (or in a hospital), to enable a medical practitioner to observe the patient remotely.

Alternatively, it will be appreciated that the body support platforms may be located within a hospital, and monitoring data may be sent from each body support platform (and any associated medical devices) to a monitoring site overseen by a medical practitioner or healthcare worker.

Further, the processor may be configured to receive data from a remote site such as that of a medical practitioner, to enable the operation of the body support platform to be altered.

The smoke or heat detector is connected to a controller and a network, and can be connected to other such body support platforms to cause their platform members to move, and/or to cause audible alarms to sound. This application is considered to be of particular benefit in hospitals and hotels, for example in order to wake a number of sleeping people in the event of fire. Such provision for responding to fires or other emergencies may be implemented elsewhere, and it will be appreciated that a number of body support apparatuses may be used and interconnected, wirelessly or otherwise, in the same dwelling (e.g. domestic home), or building, or area.

The body support platform is connected to surveillance, security or burglar alarm systems, and any connected sensing or monitoring devices such as motion detectors, cameras, trip sensors, heat sensors etc. The platform members may be actuated to alert the user to the presence of an intruder or some other suspicious event, and details of the event, and/or a picture of the event, may be displayed on the display screen. An audible alarm may be activated. Alternatively, the platform members may be actuated substantially silently, without sounding the alarm, in order to alert the user and not disturb others.

Alternatively, or in addition, the body support platform may be connectable to an electronic calendar or diary. This may be provided by a personal computer directly connected to the body support platform, or by a remote computer or server connected to the body support platform via a network. Alternatively, a remote control unit with an integral alarm clock could be provided. Thus, the body support platform may be operable to cause the platform members to be actuated, or an alarm or voice message to be activated to alert the user of a forthcoming appointment or other calendar/diary entry. This alarm may be linked to an electronic diary system to notify or awaken a user at an appropriate time or alternatively to provide a limited period of operation.

The body support platform may comprise or be connected to lights under or around the body support platform. Sensors may be provided in the body support platform that is operable to detect movement around the bed and to illuminate the lights in response.

One embodiment of the present invention enables a bed to be designed specifically to the requirements of a customer/user. The choosing of a design can take place in a private assessment area of a retail outlet or in the comfort of the customer's home. This is made possible by the modular nature of the design making it more portable. The body support platform can be provided as a kit of parts comprising a plurality of bases, and a plurality of columns or separate balls. Also optional additional components can be provided such as actuators and controllers or a central control unit, an airflow unit, computer control functionality, trays (designed to be attachable to the furniture frame specific to the type of body support platform), furniture frame. This enables the specification and functionality of the body support platform to be tailored to the requirements of the customer.

The method of design can entail the receiving of a request for the body support platform e.g. a bed which includes the desired dimensions of the bed and an indication of the bed comfort level or the weight of the customer to enable an initial set of columns or balls to be chosen which are likely to have stiffnesses which approximate to the customer's requirements. The bed can then be assembled from a plurality of units and/or modules to the desired size and the columns or balls can then be applied to the base to enable the customer to try the design. Modifications to the design can then be made depending upon the customer's feedback. For beds, it may be appropriate to allow the customer to try the bed overnight in their home. Alternatively after a short trial time the customer is asked for their feedback so that the column or ball stiffnesses and covering padding levels can be adjusted. The customer can then retry the bed. The process of modifying the design in response to the customer feedback can be repeated to iterate towards a design that the customer is satisfied with. Once the customer is happy with the design, if the bed has been constructed at their home, it can be left with them or a new one delivered in accordance with the design parameters. If the bed has been constructed in a private assessment area of a retail outlet, a new bed can be delivered to the customer in accordance with the design parameters.

The modular nature of the body support platform also enables a new business model to be used for purchasing the body support platform. The parts are replaceable and upgradeable simply. Thus a customer need not purchase a body support platform and can instead rent one for a term. During the term the customer purchases a service which includes use of the body support platform and maintenance as a minimum. The rental business model enables the retailer to offer different service levels. For example a basic service level could be the design of a body support platform to meet your specifications, delivery of the body support platform, and maintenance of the body support platform for the term and at the end of the term the body support platform will be recovered. Higher levels of service can include upgrades such as 1. modifications to the column or ball stiffnesses when desired e.g. due to medical conditions, weight gain or loss, pregnancy, divorce etc
2. Changes to the dimensions of the body support platform e.g. changing a bed from a single to a double
3. Improving or removing features such as ventilation, actuation, multimedia interface control, alarm functionality etc The provision of the service requires payment, which can either be up front, periodic or based on a credit agreement. The level of service of course chosen can be changed by varying the agreement and payment so that a customer that signed up for a basic service can upgrade their service level to received upgrades at a later date.

When a body support platform is to be disposed of, the modular nature of the design makes recycling of reuse of parts very easy. Further, the components can be refurbished and used again. This there is a retained second hand value due to the hygienic design. Individual parts are cleanable (e.g. steam cleanable) and individually refurbishable if required. Hence the parts can be used again in any combination. Parts which are not reusable due to excessive wear or damage for example can easily be recycled since they will generally be made of one or a limited number of materials.

Stock of the columns or balls and other components can be carried on specially designed delivery vehicles which can receive the data of a particular bed specification chosen by a customer live from a showroom and be able to deliver and configure a bespoke bed to the customers' requirements to their premises on the same day of purchase or even by the time the customer reaches home (if already in the vicinity).

Downloadable audible and visual media with embedded pre synchronised actuation programmes for entertainment or medical purposes can be made available. This would provide an additional after sale revenue stream which can be purchased individually or as part of service contract taken up initially or upgraded to at a later date.

In one embodiment of the present invention, the base is provided with wiring and/or air duct connections allowing the modular upgrading of the bed by the addition of components or replacement with higher capability components. The functionality of the bed can thus be enhanced. Such functionality comprises, for example, actuation, music, ventilation, television or video functions, internet functions, audio capability, lighting (e.g. mood lighting) etc.

Although the present invention has been described with reference to specific embodiments, it will be apparent to a skilled person in the art that modifications lie within the spirit and scope of the present invention.

Although the embodiments have been described with reference to a moulded base, which is light weight, particularly facilitates simplified manufacture and air flow there through, the present invention is not limited to a moulded base and any solid form of base can be provided such as a solid plastic or metal base. The term solid used in this invention refers to the physical properties of the base i.e. as opposed to soft and it is not used to infer any surface properties.

The present invention encompasses any type of body support platform, for example furniture including beds, couches, sofas, seats, benches, chairs, sofas etc. Other body support platforms can include operating tables, sun-beds etc. Thus the term body support platform encompasses any construction having a support surface on which a human being lies or sits for a period of time.

Although in the embodiments the modules are shown with no ventilation unit and a central ventilation unit is used to supply air throughout the base, each module can be provided with a ventilation unit, which can in its simplest form comprise a fan. However, each ventilation unit can include an air conditioning unit for controlling air temperature, humidity and even smell to allow for regional variations in the ventilation across the support surface of the body support platform. The local ventilation units can be connected to a controller and centrally controlled using the controller (computer). With such local ventilation, the provision of interconnecting ventilation ducts is not required.

In embodiments of the invention lighting can be provided in the base of the bed which can be controlled using a controller and can be set to react to audio or video inputs to provide mood lighting.

In one embodiment inflation means is provided for supplying gas to said balls for the inflation of said balls. In one embodiment, the inflation means is adapted to inflate said balls to different pressures. In one embodiment, the inflation means is adapted to inflate said balls to different pressures in different layers of balls or in different regions across said body support surface.

The invention claimed is:

1. A body support platform for supporting a human body, comprising one or more body support unit(s), the or each support unit comprising:

a plurality of columns, each column comprising a stack of fluid-fillable substantially spherical resilient balls, each ball of a respective column being physically and fluidly connected only to the adjacent ball(s) within said column, such that a column may be compressed substantially independently of a neighbouring column; and a base providing a primary fluid reservoir;

wherein said columns are arranged in an array across said base; and each of said columns is connected to said base, such that the lowermost ball of each respective column is directly fluidly connected to said primary fluid reservoir; and wherein the uppermost ball of respective columns collectively define a body support surface.

2. The body support platform of claim 1 wherein at least one ball in a column has a different resiliency to at least one other ball in said column.

3. The body support platform of claim 1, further comprising at least one band provided around at least one unit, to affect the resiliency of said unit(s).

4. The body support platform of claim 3, wherein the height of the band is less than the height of a ball and wherein the band is provided around the outermost columns of the unit, such that the band lies substantially horizontally and co-planer with the body support surface.

5. The body support platform of claim 4, wherein the band lies substantially in a plane including the physical connections between respective adjacent balls of each outermost column.

6. The body support platform of claim 4, comprising a plurality of bands being provided around the unit, spaced apart from one another, wherein the resiliency of each band around said unit is different to that of at least one of the other band(s) around said unit.

7. The body support platform of claim 1, wherein the balls in a column are fluidly connected by means of openings, valves or a fluid conduit which traverses the height of said column.

8. The body support platform of claim 1, wherein at least one column is removably connected to the base.

9. The body support platform of claim 1, wherein the array comprises N×M columns arranged in a regular grid pattern.

10. The body support platform of claim 1, wherein the base is hollow and has a plurality of ports, each port for receiving the lowermost ball of a column in a unit and including an opening allowing each of said lowermost balls to be directly fluidly connected to the primary fluid reservoir.

11. The body support platform of claim 1, the base further comprising a reservoir charging port through which the primary fluid reservoir may be charged with fluid, the charging part having a one-way valve to substantially prevent the flow of fluid out of the primary fluid-reservoir.

12. The body support platform of claim 1, wherein each primary fluid reservoir has an independent fluid source.

13. The body support platform of claim 1 further comprising one or more modules, each module comprising a plurality of units.

14. The body support platform of claim 1, further comprising one or more trays, wherein the or each tray receives a respective module.

15. The body support platform of claim 14, wherein each tray further provides a fluid supply in fluid communication with the primary fluid reservoirs of each unit.

16. The body support platform of claim 14, wherein each base further comprises at least one vent to enable the distribution of ambient air between the columns of the units.

17. The body support platform of claim 16, further comprising a fan connected to the at least one vent.

18. A kit of parts for fabrication of a body support platform for providing support for a human body, the kit of parts comprising:

a plurality of units, each unit comprising a plurality of columns, each column comprising a stack of fluid-fillable, substantially spherical resilient balls, each ball of a respective column being physically and fluidly connected only to the adjacent ball(s) within said column, such that a column may be compressed substantially independently of a neighbouring column; and a base providing a primary fluid reservoir;

wherein said columns are arrangable in an array across said base; and wherein each of said columns is connectable to said base, such that the lowermost ball of each respective column is directly fluidly connected to said primary fluid reservoir.

19. A bed, comprising:

a bed frame, a body support platform comprising one or more body support unit(s) according to claim 1, and at least one tray removably attached to the bed frame, each tray receiving a plurality of units.

20. The body support platform of claim 1, further comprising a plurality of actuators, each actuator being arranged to reciprocally move a respective column perpendicularly to the body support surface and being located at the end of said column that is distal from the body support surface, and further comprising a ventilation system for providing ventilation through said support surface and a control system for controlling said actuators, and said ventilation system including a user interface to allow a user to select ventilation conditions and support surface tactile conditions and for controlling said actuators and said ventilation system depending upon the user's selections.

* * * * *

UNITED STATES PATENT AND TRADEMARK OFFICE

CERTIFICATE OF CORRECTION

PATENT NO. : 8,307,481 B2
APPLICATION NO. : 13/496358
DATED : November 13, 2012
INVENTOR(S) : Joseph Meir Katan It is certified that error appears in the above-identified patent and that said Letters Patent is hereby corrected as shown below:

On the Title Page, item [73]
List "BALLUGA LTD" as the Assignee and "London, United Kingdom" as Assignee's city and country of the Assignee on the Letters Patent.

Signed and Sealed this
Nineteenth Day of August, 2014

Michelle K. Lee

Michelle K. Lee
*Deputy Director of the United States Patent and Trademark Office*